US006893231B2

(12) United States Patent
Achten

(10) Patent No.: US 6,893,231 B2
(45) Date of Patent: May 17, 2005

(54) HYDRAULIC DEVICE

(75) Inventor: Peter A. J. Achten, Eindhoven (NL)

(73) Assignee: Innas Free Piston, B.V. (NL)

( * ) Notice: Subject to any disclaimer, the term of this patent is extended or adjusted under 35 U.S.C. 154(b) by 0 days.

(21) Appl. No.: 10/449,038

(22) Filed: May 29, 2003

(65) Prior Publication Data

US 2003/0221550 A1 Dec. 4, 2003

Related U.S. Application Data

(63) Continuation of application No. PCT/NL01/00840, filed on Nov. 20, 2001.

(51) Int. Cl.[7] ..... F04B 23/00; F04B 1/12; F04B 27/08; F04B 23/04; F01B 13/04

(52) U.S. Cl. ..... 417/440; 417/269; 417/270; 417/521; 91/472

(58) Field of Search ..... 91/472, 476; 417/269, 417/270, 521, 522, 440

(56) References Cited

U.S. PATENT DOCUMENTS

| | | | | |
|---|---|---|---|---|
| 3,156,192 A | | 11/1964 | Austin et al. | 103/162 |
| 3,202,105 A | | 8/1965 | Badenoch et al. | 103/162 |
| 4,007,663 A | * | 2/1977 | Nagatomo et al. | 417/269 |
| 4,096,786 A | * | 6/1978 | Schauer | 91/499 |
| 4,945,816 A | * | 8/1990 | Mestieri | 91/476 |
| 5,634,776 A | * | 6/1997 | Leemhuis et al. | 417/270 |
| 5,918,529 A | | 7/1999 | Forster | 91/12.2 |
| 6,024,541 A | * | 2/2000 | Perstnev et al. | 417/269 |

FOREIGN PATENT DOCUMENTS

| | | |
|---|---|---|
| FR | 1260078 A | 8/1961 |
| FR | 2082604 A | 12/1971 |
| NL | 1009607 C | 1/2000 |

OTHER PUBLICATIONS

International Search Report for PCT Application No. PCT/NL01/00840 mailed Mar. 14, 2002.

* cited by examiner

*Primary Examiner*—Cheryl Tyler
*Assistant Examiner*—Timothy P. Solak
(74) *Attorney, Agent, or Firm*—St. Onge Steward Johnston & Reens LLC

(57) ABSTRACT

The invention relates to a hydraulic device provided with a housing having at least a first line connection and a second line connection and, if appropriate, further line connections, a rotor which can rotate in the housing and chambers which are alternately connected to one of the line connections as a result of the rotation of the rotor. According to the invention, chambers are connected by connecting lines in which there are means for closing a connecting line after a limited volume of fluid has flowed through the connecting line in one direction.

8 Claims, 4 Drawing Sheets

HYDRAULIC DEVICE

PRIOR APPLICATIONS

This application is a continuation of pending International Patent Application No. PCT/NL01/00840 filed Nov. 20, 2001 which designates the United States and claims priority of pending Netherlands Application Nos. 1016739 filed Nov. 29, 2000, 1016828 filed Dec. 8, 2000, 1018152 filed May 25, 2001.

Applicant claims priority to PCT Application No. PCT/NL01/00840, filed Nov. 20, 2001.

BACKGROUND OF THE INVENTION

The invention relates to a hydraulic device with connecting lines between chambers. When in a device of this type, during rotation of the rotor the connection of a chamber to one line connection changes to a connection to a successive line connection, the connections to the chamber are gradually closed and opened again. When, during the closing of one connection and the opening of the other connection, the volume of the chamber changes, a pressure peak is formed, which may cause excessive noise or cavitation, which can give rise to damage. Measures are taken to avoid this, such as the provision of leakage gaps or allowing a limited short circuit by connecting a chamber to two line connections during a limited rotation. These measures reduce the problem of the pressure peak and/or cavitation but are only effective for certain pressure ratios, pressures in the line connections or rotational speeds of the rotor, settings of the rotational position of the face plate and/or a combination thereof. In addition, these measures entail energy loss. This limits the application of the device.

SUMMARY OF THE INVENTION

To avoid the above drawbacks, the device is designed with connecting lines between chambers with which connecting lines are provided with closures means. This avoids pressure peaks and cavitation, while the energy losses also decrease.

According to one embodiment, the device is designed with closure means and has an element which can move in a sealed manner inside a cylinder. This allows a further low-loss reduction in the pressure peaks, since unintentional flow of oil from one chamber to the next chamber is impossible.

According to a refinement, the device is designed with a closure means comprising a cylinder with valve seats at both ends. This allows a simple design which is also easy to vent.

According to a refinement, the device is designed with a passage. This further improves the venting of the device.

According to a refinement, the device is designed with an element that has a diameter that is greater than half the maximum movement of the element in the flow direction. This improves the dynamic performance of the device, since the length of the oil column which has to be accelerated or decelerated in the connecting line is limited.

According to another embodiment, the device is designed with a closure means comprising a diaphragm positioned between the two chambers. This allows an inexpensive design.

According to a refinement, the device is designed with a connecting line having a cross section that is at least 30% of the cross section by means of which a chamber is in open communication with a line connection. This greatly reduces the losses and allows high rotational speeds of the rotor.

According to a refinement, the device is designed with the connecting line arranged in the rotor. This allows the device to be of compact design while also avoiding problems with seals.

BRIEF DESCRIPTION OF DRAWINGS

The invention is explained below with reference to an exemplary embodiment and with the aid of a drawing, in which.

DETAILED DESCRIPTION OF THE INVENTION

Figure 1:
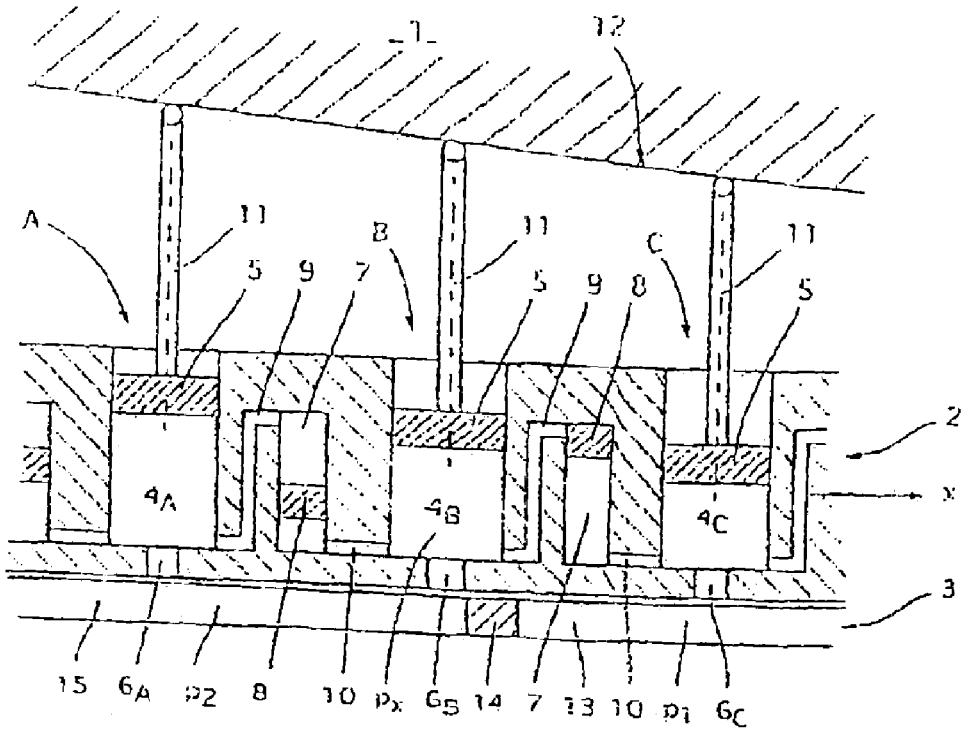
FIG. 1 diagrammatically depicts the way in which the invention operates.

FIG. 1 diagrammatically depicts a rotor 2 with rotor chambers $\mathbf{4}_A$, $\mathbf{4}_B$ and $\mathbf{4}_C$. The rotor 2 rotates in a housing 1. In the housing 1 there is a face plate 3 with a first face-plate port 13 and a second face-plate port 15. The face-plate ports 13 and 15 are separated by a rib 14. The first face-plate port 13 is connected to a line which is at a first pressure $P_1$. The second face-plate port 15 is connected to a line which is at a second pressure $P_2$. The rotor chambers 4 are each provided with a piston 5, so that the volume in the chamber 4 can vary between a minimum value and a maximum value by means of a displacement mechanism which in this case is diagrammatically indicated by a rod 11 and a guide 12. The rotor chamber 4 is in communication, through a rotor port 6 and face-plate port 13 or 15, with a line for supplying or discharging oil.

The rotor 2 rotates about an axis of rotation, during which movement rotor ports 6 move along the face plate 3. Each rotor port 6 is initially in open communication with the second face-plate port 15. The pressure in the rotor chamber 4 is then equal to the second pressure $P_2$. After the rotor port 6 has passed the rib 14, the rotor port 6 is in open communication with the first face-plate port 13, and the pressure in the rotor chamber 4 is equal to the first pressure $P_1$. The rib 14 is dimensioned in such a way that the rotor port 6 is completely closed for a short time, so that it is impossible for there to be a short circuit between the first rotor port 13 and the second rotor port 15.

Figure 2:
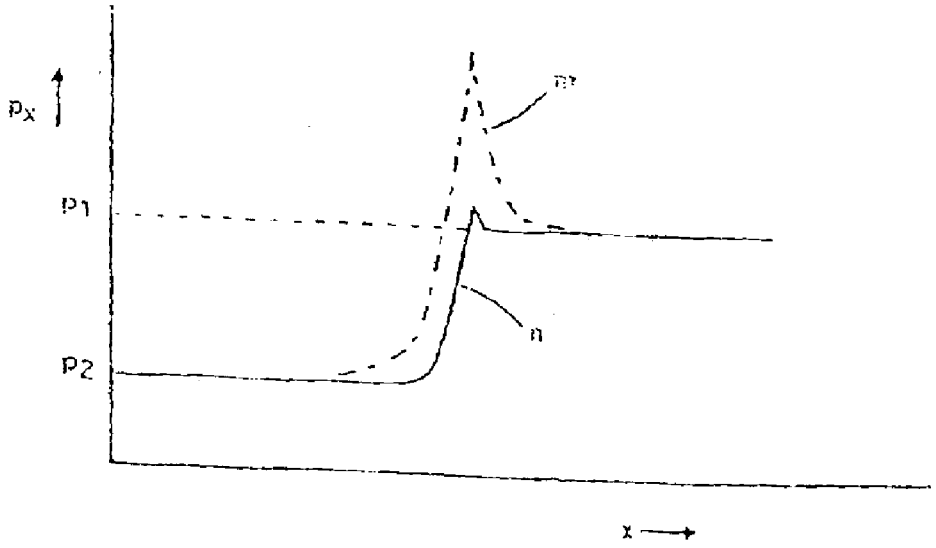
FIG. 2 shows the pressure profile in a rotor chamber shown in FIG. 1.

In known rotors 2 oil is only supplied or removed via the rotor port 6. When this rotor port 6, during movement of the rotor 2, is completely or partially closed off by the rib 14 and the volume of the rotor chamber decreases under the influence of the guide 12 and the rod 11, the oil in the rotor chamber 4 will be elastically compressed, with the result that a rotor-chamber pressure $P_x$ rises. The rotor-chamber pressure $P_x$ is indicated in FIG. 2 as a function of the displacement of the rotor 2 in a direction x. A line m indicates the rotor-chamber pressure $P_x$ as it rises in the known rotors 2 as a result of the opening 6 being closed by the rib 14. The illustrated rise in pressure is undesirable, since such a rapid rise in pressure causes excessive noise.

In order to prevent the pressure peaks in the rotor chamber 4 referred to above, according to the invention a valve chamber 7 in which there is a valve piston 8 is arranged between the rotor chambers. The space above the valve piston 8 is in communication, via a passage 9, with the first rotor chamber, in this case, for example, $\mathbf{4}_B$, and the space below the valve piston 8 is in communication with the second rotor chamber, in this case, for example, $\mathbf{4}_C$.

In the situation in which the first pressure $P_1$ is higher than the second pressure $P_2$, the pressure in the rotor chamber $\mathbf{4}_C$ is higher than in the rotor chamber $\mathbf{4}_B$. As a result of this pressure difference, the valve piston 8 between rotor chamber $\mathbf{4}_B$ and $\mathbf{4}_C$ will be positioned at the top of the valve chamber 7, as shown in FIG. 1. In this position, this valve piston 8 closes the passage 9, so that it is impossible for any oil to flow out of the rotor chamber $\mathbf{4}_C$ to the rotor chamber $\mathbf{4}_B$.

When the rotor 2 moves in the direction x, the rib 14 will close off the opening $\mathbf{6}_B$. On account of the downwardly directed movement of the piston 5, there is a flow of oil through the rotor port $\mathbf{6}_B$, which is impeded and in many cases ultimately stopped. As a result, the pressure $P_x$ rises, and the oil will first of all flow out through passage 10. The valve piston 8 between the rotor chamber $\mathbf{4}_A$ and $\mathbf{4}_B$ is subject to no resistance or only a limited resistance from the pressure in the rotor chamber $\mathbf{4}_A$ and will move into its uppermost position. After this valve piston 8 has reached its limit position, the flow of oil through passage 10 stops and the pressure in the rotor chamber $\mathbf{4}_B$ rises until it is equal to the first pressure $P_1$. Then, the flow of oil through passage 9 commences, and the valve piston 8 between the rotor chambers $\mathbf{4}_B$ and $\mathbf{4}_C$ will effect a flow of oil to the rotor chamber $\mathbf{4}_C$.

The rotor-chamber pressure $P_x$ in the embodiment according to the invention is shown by a line n in FIG. 2. It is clearly apparent that the pressure changes from the second pressure $P_2$ to the first pressure $P_1$ with a much lower pressure peak, so that the excessive noise is greatly reduced. The peak which can be seen in FIG. 2 at line n results from the high rotational speed of the rotor, in this case 7200 rpm. Consequently, the acceleration of the valve piston 8 and the oil play a role. This pressure peak therefore forms on account of the mass of the oil column and the valve piston 8 to be accelerated. The volume which has to be able to flow through the passages 9 and 10 during the closing and opening of the rotor port 6 is dependent on the displacement of the piston 5 during the time when the rotor port 6 is closed by the rib 14.

The explanation given above has demonstrated that the valve chambers 7 are always arranged between two successive rotor chambers 4. Naturally, operation is similar if one or two rotor chambers 4 in each case lie between the rotor chambers 4 which are connected to a valve chamber 7.

The principle of operation described above is explained in more detail below by means of an exemplary embodiment.

Figure 3:
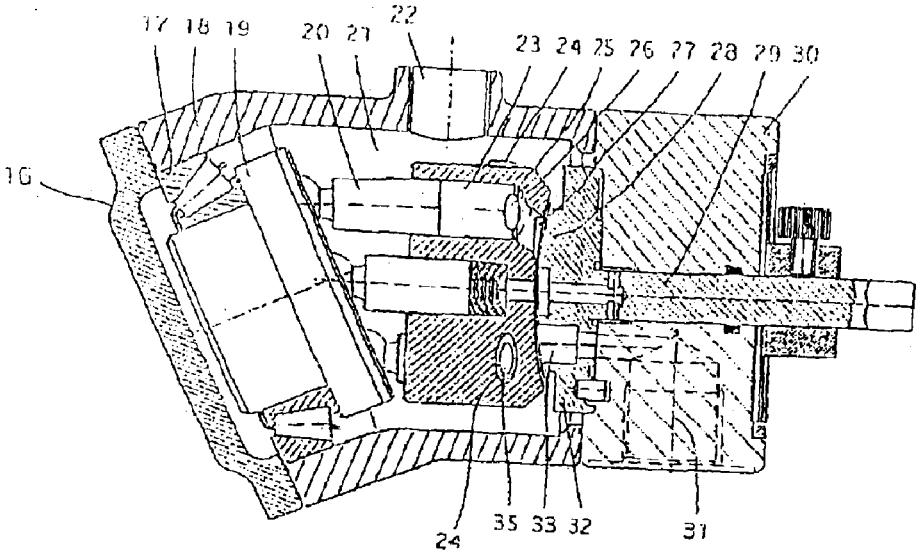
FIG. 3 shows a diagrammatic cross section through a hydraulic pressure transformer according to the invention.

FIG. 3 shows a hydraulic pressure transformer with a rotor 25 which is rotatably secured in a housing 18. The rotor 25 has rotor chambers 23, the volume of which can vary between a minimum value and a maximum value through displacement of a plunger 20. The plungers 20 are coupled to a shaft 19 which is secured in the housing 18 by means of a bearing 17. The axis of rotation of shaft 19 intersects the axis of rotation of the rotor 25 at an angle, so that the plungers 20 can move in a reciprocating manner in the rotor chambers 23. On the side which is remote from the plunger 20, the rotor chambers 23 are provided with a passage which ends in a rotor port 27. The rotor ports 27 move along a circular path past a face plate 32 and, via three face-plate ports 33, are alternately connected to one of the two line connections 31 or a low-pressure connection 22.

Between the face-plate ports 33 there are ribs 28 which, when the rotor 25 rotates, close off the rotor ports 27 for a short time. The line connections 31 are arranged in a connection cover 30 which is provided with passages which are in communication with the corresponding face-plate port 33. One of the face-plate ports 33 is in open communication with an internal space 21 of the housing 18. The internal space 21 is closed off by a cover 16, and the housing 18 is provided with the low-pressure connection 22 The face plate 32 is provided with a face-plate shaft 29, by means of which the face plate 32 can be rotated and by means of which the ratio of the fluid pressures in the line connections 31 can be set.

Figure 4:
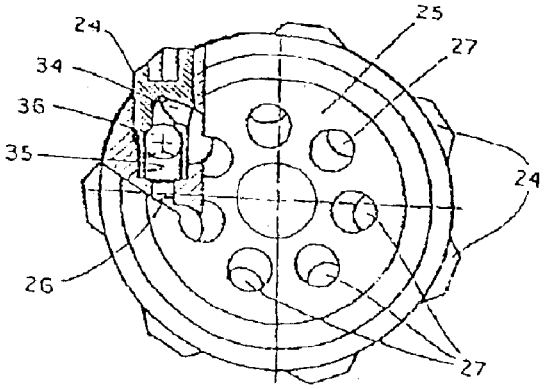
FIG. 4 shows a front view of the rotor of the hydraulic pressure transformer shown in FIG. 3.
Figure 5:
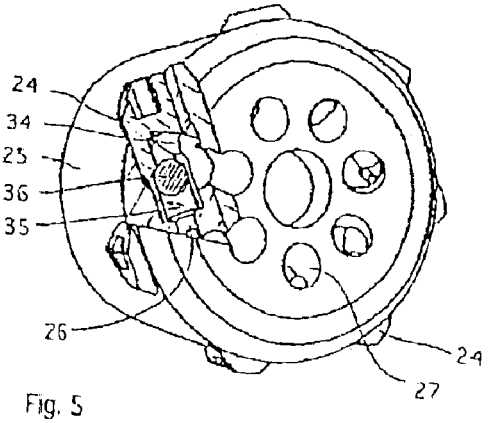
FIG. 5 shows a perspective view of the rotor shown in FIG. 3, and FIGS. 6–9 show the way in which the device shown in FIG. 3 operates in various rotary positions of the rotor.
Figure 6:
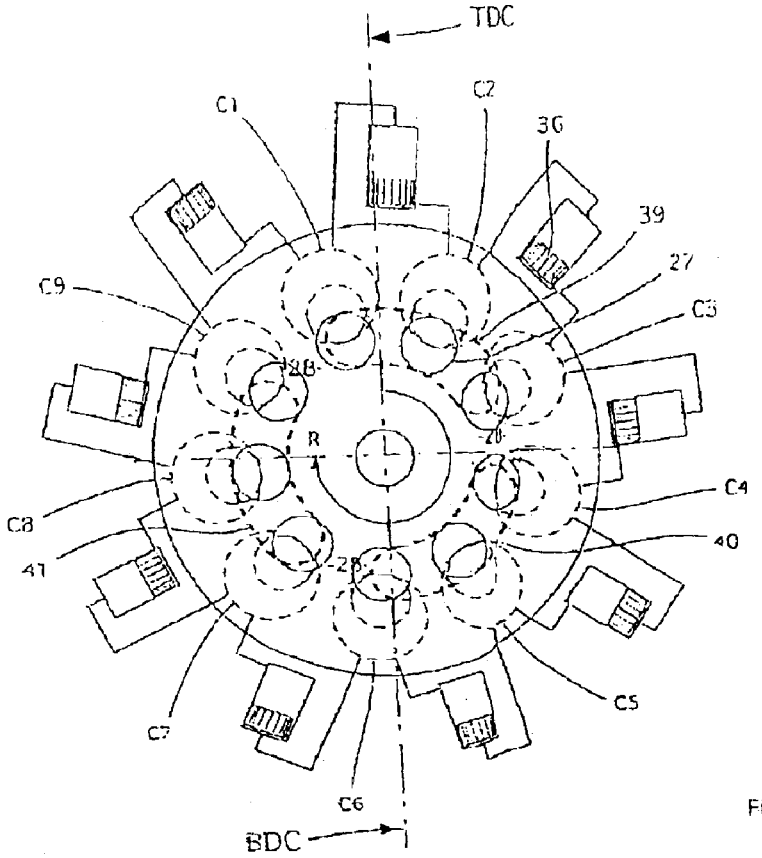
Figure 7:
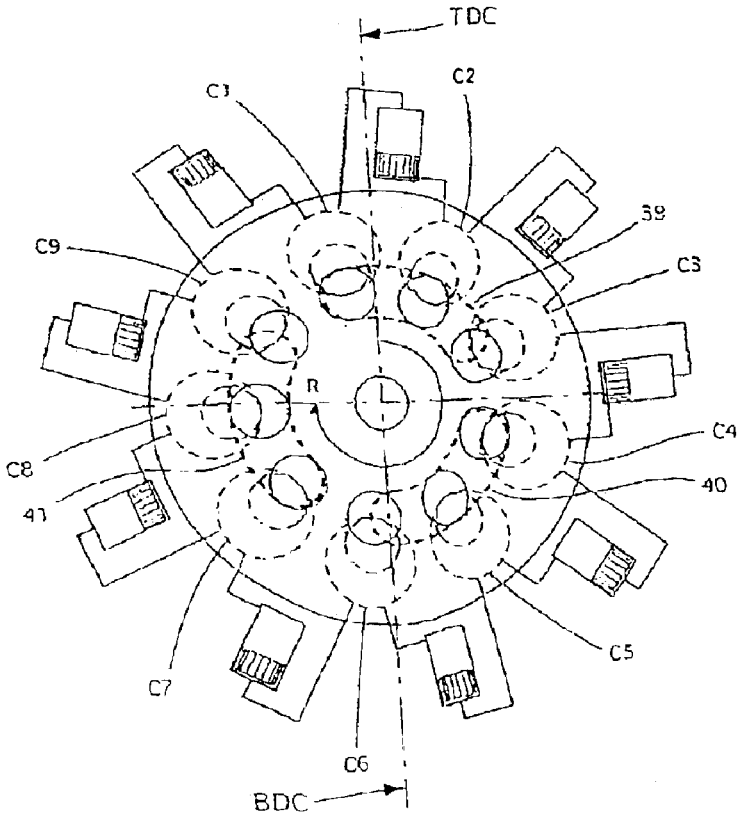
Figure 8:
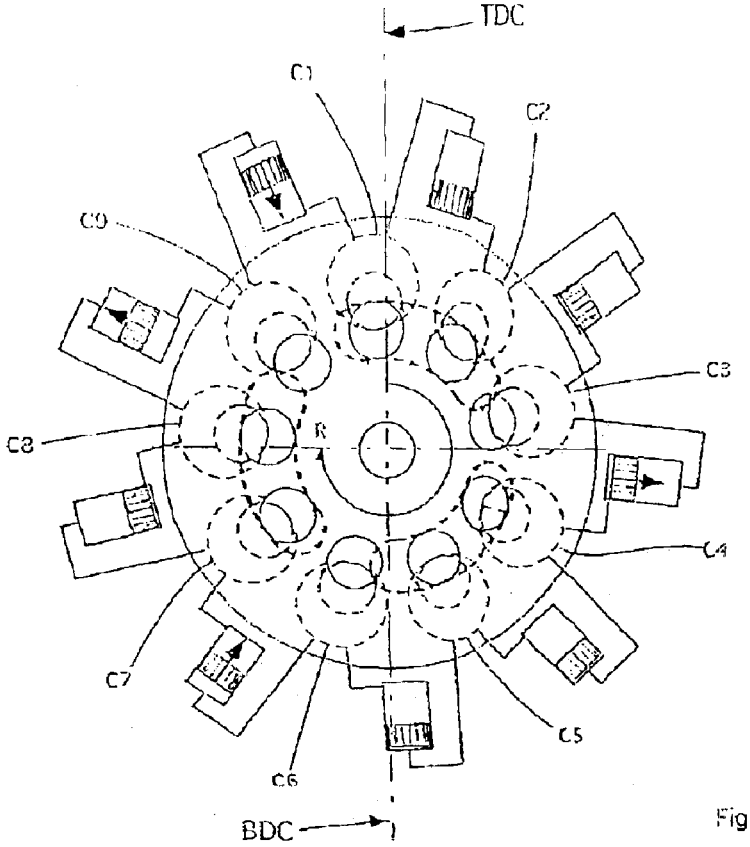
Figure 9:
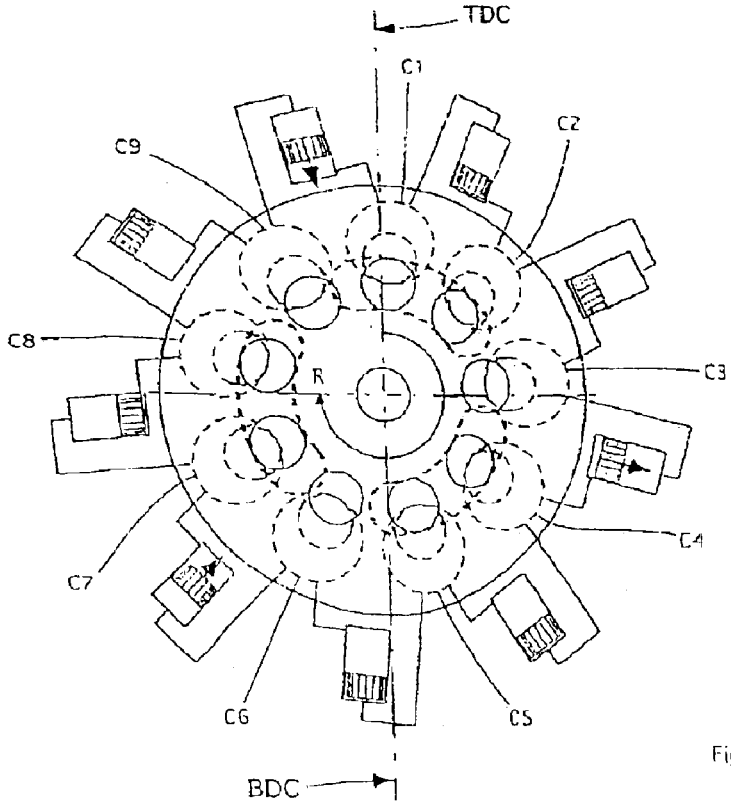

FIGS. 4 and 5 show the rotor 25 in more detail. In the side of the rotor 25, a bore is in each case arranged between two rotor chambers 23, in the vicinity of the rotor port 27. A closure piece 24 is arranged in this bore. In this closure piece 24 there is a valve chamber 35 in which a ball 36 can move, and a bore 34 which brings the base of the valve chamber 35 into communication with one of the rotor chambers 23. The open end of the valve chamber 35 is connected, by means of a passage 26, to the other rotor chamber 23.

In the mounted state of the closure piece 24 with the ball 36 in the rotor 25, the ball 36 blocks the flow of oil between the two rotor chambers 23 when the ball 36 has moved with the flow over a travel length s and, at one of the two ends of the valve chamber 35, has come to rest against a conical valve seat In the process, a limited volume of oil has flowed from one rotor chamber 23 to the other rotor chamber 23; this volume is approximately equal to the product of the surface area of the ball 36 and the travel length s. The travel length s is therefore the maximum distance over which the ball 36 can move between the valve seats. The diameter of the ball 36 is greater than half the travel length s, so that the ball 36 is carried along by the liquid with little resistance. If appropriate, the diameter of the ball 36 may be greater than the travel length s. The material of the ball 36 is as lightweight as possible, and the ball is made, for example, from ceramic material.

There is a certain clearance between the ball 36 and the valve chamber 35, so that a limited flow of oil past the ball 36 can take place. This enables the pressure change in the rotor chambers 23 to take place more gradually, allows the rotor to be vented and prevents local heating of the oil. If appropriate, to this end a groove is arranged in the longitudinal direction in the wall of the valve chamber 35.

To limit the build-up of pressure in the rotor chamber 23 when the rotor port 27 is being closed off by the rib 28, the passage 26 and the bore 34 have a surface area which is at least 30% of the surface area of the rotor port 27; as a result, there will be little resistance to flow.

As an alternative to the embodiment illustrated with a ball 36 which comes to rest on a conical valve seat, other embodiments are also possible, for example a piston which can move in a sealed manner in the valve chamber 35, with the passages being connected to the side of the valve chamber 35. In the limit position, this piston comes to a stop against a closed volume of oil, so that an impact between the piston and the rotor is avoided, thus reducing wear.

The way in which the hydraulic transformer shown in FIG. 3 operates is explained below with reference to FIGS. 6, 7, 8 and 9, which show various rotational positions of the rotor 25. In the figures, TDC (top dead center) denotes the position of the rotor 25 in which the volume of the rotor chambers 23 is at its minimum. BDC (bottom dead center) denotes the position in which the volume of the rotor chambers 23 is at its maximum. The valve chamber 35 and the ball 36 are diagrammatically indicated.

As discussed above, the face plate 32 is provided with three face-plate ports 33 of equal size, the high-pressure port 39 being connected to a line connection 31 which is at high pressure, the low-pressure port 40 being connected to a line connection 22 which is at low pressure and the medium-pressure port 41 being connected to a line connection 31 which is at a pressure which can be adjusted by varying the rotational position of the face plate 32. The face plate 32 is adjusters by means of the face-plate shaft 29 in such a manner that the rotor 25, under the influence of the high pressure in the high-pressure port 39, starts to rotate in the direction of rotation R. As a result of this rotation, the plungers 20 will cause oil to be sucked out of the high-pressure port 39 and the low-pressure port 40 and forced into the medium-pressure port 41.

In the rotor 25, there are nine rotor chambers 23, numbered C1–C9, and the valve chamber 35 and ball 36 are diagrammatically indicated outside the rotor 25. The behavior of the ball 36 during closing of the rotor port 27 by the three ribs 28 will be discussed in succession.

FIGS. 6–9 show that the rotor port 27 of C3 is being closed to an ever increasing extent as a result of the rotation. Before the closing begins, the ball 36 is pushed into the position illustrated during the rotation toward the high-pressure port 39, in a manner which is to be indicated below. Even when the rotor port 27 of C3 is more or less closed, the volume of the rotor chamber 23 continues to increase on account of the rotation R, and a low pressure is formed, which also becomes lower than the pressure in the low-pressure port 40. As a result, the ball 36 in the valve chamber 35 between C3 and C4 will start to move in a direction which is indicated by an arrow in FIGS. 8 and 9. There will be little reduction in pressure or cavitation.

The rotor port 27 of C6 is also being closed. During this closing operation, the volume of the rotor chamber 23 will decrease. Since the pressure of C7 is higher than that of C6, in the first instance, before the ball 36 in the valve chamber 35 between C5 and C6 has reached the end of its travel, the oil will be pressed out of C6 toward C5. When this is no longer possible, on account of the ball 36 having reached the end of its travel, the pressure in C6 will rise until it is equal to the pressure in C7, and then the oil from C6 will displace the ball 36 in the valve piston 35 between C6 and C7 as indicated by an arrow in FIGS. 8 and 9. There will be no pressure peak produced in C6.

To close off the rotor port 27 of C9, the ball 36 in the valve piston 35 between C1 and C9, under the influence of the pressure in C1 during the closing of the rotor port 27 thereof, has adopted the position indicated. During the closing of C9, the volume of the rotor chamber 23 decreases, and when the opening of the rotor port 27 is small enough, the pressure in C9 rises and the ball 36 in the valve chamber 35 between C8 and C9 moves under the influence of this higher pressure. After the ball 36 has reached its limit position, the pressure rises further until it is equal to the pressure in C1, which is equal to the pressure in the high-pressure port 39. During further reduction of the volume of C9, the oil will displace the ball 36 in the valve chamber 35 between C9 and C1, as indicated by arrows in FIGS. 8 and 9. In this case too, there are no pressure peaks.

The use of the ball 36 between the rotor chambers 23 also avoids pressure peaks in other rotary positions of the face plate 32, with the result that excessive noise is reduced. One embodiment may involve a diaphragm being used instead of the ball 36, which diaphragm keeps the pressures in rotor chambers 23 which adjoin one another equal for a limited flow of oil, with the diaphragm also closing off an opening which can cause the pressure difference to rise considerably.

The exemplary embodiment shows a rotor 25 with axial plungers 20. The person skilled in the art is familiar with numerous other designs, such as wing pumps, radial plunger pumps, rotor pumps and roller pumps and corresponding motors, the volume of the chambers changing as a result of rotation. Numerous arrangements for alternately connecting chambers which change in volume as a result of rotation of a rotor to different line connections are also known. The invention can be applied equally well to these various applications for the purpose of avoiding pressure peaks and cavitation.

In the exemplary embodiment of the rotor 25 which is illustrated, the successive rotor chambers 23 are in each case connected to one another. Naturally, it is also possible for the rotor chambers 23 which lie one or two rotor chambers 23 apart, as seen in the direction of rotation, to be connected to one another. The invention is illustrated on the basis of a hydraulic transformer, with three face-plate ports 33 arranged in the face plate 32. Naturally, embodiments with six or nine face-plate ports are also possible. The invention can also be used for hydraulic pumps and motors with two line connections, in which a torque is exerted on the rotor or in which the rotor is used to drive something.

In the exemplary embodiment illustrated, it has been assumed that the three ribs 28 between the face-plate ports 33 and also the three face-plate ports 33 are of identical size. In connection with the different movements which the balls 36 execute in the valve chamber 35 during the movement of the rotor ports 27 past the various face-plate ports 33 and the high-pressure port 39, the low-pressure port 40 and the medium-pressure port 41, it is possible to further optimize the movement, of the balls 36. This can be achieved by providing the ribs 28 and/or the face-plate ports 33 with different dimensions. For example, it is possible to increase the size of the rib 28 between the high-pressure port 39 and the medium-pressure port 41, so that there is more time for the double movement of the balls 36 during this transition. As a result it is possible, for example, to increase the permissible rotational speed or to reduce the losses at high rotational speeds. The size of the rib 28 can be increased, for example, by reducing the sizes of the high-pressure port 39 and the medium-pressure port 41 to equal extents and/or by reducing the size of the low-pressure port 40. Depending on the particular application, it is also possible to select different dimensions or for all the ports and ribs to acquire different dimensions.

What is claimed is:

1. A hydraulic device comprising a housing provided with at least a first line connection and a second line connection which are at respectively a first pressure and a second pressure, a rotor which can rotate in the housing, a plurality of chambers, the volume of which varies between a minimum value and a maximum value as a result of the rotation of the rotor, and means for successively connecting each chamber to the first line connection, the second line connection and any further line connections as a result of rotation of the rotor, characterized in that there are a plurality of connecting lines between chambers, which connecting lines each are provided with closure means for closing a connecting line after a limited volume of fluid has flowed through the connecting line in one direction.

2. The hydraulic device as claimed in claim 1, characterized in that the closure means comprise an element which can move in a sealed manner inside a cylinder.

3. The hydraulic device as claimed in claim 2 characterized in that the diameter of the element is greater than half the maximum movement of the element in the direction of flow.

4. The hydraulic device as claimed in claim 1, characterized in that the closure means comprise a cylinder with, at both ends, valve seats for closing off the flow by means of an element which can move freely inside the cylinder.

5. The hydraulic device as claimed in claim 4, characterized in that the element is provided with a passage for allowing flow past the element which is moving inside the cylinder.

6. The hydraulic device as claimed in claim 4, characterized in that the cylinder is provided with a passage for allowing flow past the element which is moving inside the cylinder.

7. The hydraulic device as claimed in claim 1, characterized in that the cross section of the connecting line is at least 30% of the cross section by means of which a chamber is in open communication with a line connection.

8. The hydraulic device as claimed in claim 1, characterized in that the connecting line is arranged in the rotor.

* * * * *